United States Patent [19]

DeVillez

[11] Patent Number: 4,850,118

[45] Date of Patent: Jul. 25, 1989

[54] HUMIDITY CONTROL FOR ROLL PAPER ELECTROSTATIC PLOTTERS

[75] Inventor: David W. DeVillez, Fullerton, Calif.

[73] Assignee: Calcomp Inc, Anaheim, Calif.

[21] Appl. No.: 194,049

[22] Filed: May 13, 1988

[51] Int. Cl.[4] ..... F26B 21/08

[52] U.S. Cl. ..... 34/50; 236/44 R; 355/309; 239/121

[58] Field of Search ..... 34/50, 46, 51; 236/44 R, 44 A, 44 E, 94; 62/176.1, 176.4; 239/102.2, 121, 120, 122; 261/81, DIG. 48; 312/31, 31.01, 31.03; 355/3 R, 3 SH

[56] References Cited

U.S. PATENT DOCUMENTS

| | | | |
|---|---|---|---|
| 685,652 | 10/1901 | Smith | 239/122 X |
| 2,584,650 | 2/1952 | Woodruff | 239/121 X |
| 2,642,314 | 6/1953 | Pupasquier | 239/120 |
| 3,468,036 | 9/1969 | Blaettler | 34/50 X |
| 3,496,731 | 2/1970 | Sholtes | 62/176.1 X |
| 3,634,007 | 1/1971 | Verderber et al. | 34/50 X |
| 4,428,207 | 1/1984 | Hall | 236/44 R |

*Primary Examiner*—Harry B. Tanner
*Attorney, Agent, or Firm*—Donald A. Streck; Wm F. Porter, Jr.

[57] ABSTRACT

A humidifying system for maintaining the moisture content of the paper at a preferred level in an electrostatic plotter. The plotter has a paper supply compartment rotatably holding a horizontal roll of plotting paper where the paper passes from the roll and through the supply compartment to a separate printing compartment. There is a powered piezoelectric humidifier for supplying cool water vapor at an outlet opening thereof. An adjustable humidistat is disposed in the paper supply compartment and operatively connected to turn the humidifier on and off as a function of the humidity in the paper supply compartment. A plastic pipe manifold is horizontally disposed across the inside of the paper supply compartment. The manifold has a closed end and an opposite end connected to the outlet opening of the humidifier. The manifold has a plurality of spaced outlet holes through sidewalls thereof along the length thereof for water vapor introduced into the manifold by the humidifier to emerge therefrom. The holes are positioned to direct water vapor emerging therefrom towards an area of the paper storage compartment having a printing surface of the paper along a side thereof and towards a sidewall of the area whereby the water vapor strikes the sidewall and bounces off to create a homogeneous cloud of the water vapor adjacent the printing surface of the paper. There is provision for condensed water vapor removal.

10 Claims, 3 Drawing Sheets

HUMIDITY CONTROL FOR ROLL PAPER ELECTROSTATIC PLOTTERS

BACKGROUND OF THE INVENTION

The present invention relates to electrostatic plotters and, more particularly, to a humidifying system for maintaining the moisture content of the paper at a preferred level in an electrostatic plotter having a paper supply compartment rotatably holding a horizontal roll of plotting paper where the paper passes from the roll and through the supply compartment to a separate printing compartment comprising, powered humidifier means including a tank for holding a supply of water to be humidified for supplying cool water vapor at an outlet opening thereof; an adjustable humidistat disposed in the paper supply compartment and operatively connected to turn the humidifier means on and off as a function of the humidity in the paper supply compartment; and, a manifold horizontally disposed across the inside of the paper supply compartment, the manifold having a closed end and an opposite end connected to the outlet opening of the humidifier means, the manifold additionally having a plurality of spaced outlet holes through sidewalls thereof along the length thereof for water vapor introduced into the manifold by the humidifier means to emerge therefrom.

The need to control moisture and humidity in electrostatic printing processes and apparatus is well known and documented. For example, the 1967 patent of Schulze, et al. (U.S. Pat. No. 3,349,221) and the 1972 patent of MacDonald, Jr. (U.S. Pat. No. 3,677,632) are both directed to heating such apparatus for the purpose of eliminating excess moisture in overly moist environments. The 1972 patent of Verderber (U.S. Pat. No. 3,634,077) is directed to a system as shown in simplified form in FIG. 1 hereof where cut sheets of paper 10 employed in an electrostatic copying process are stored and fed from an environmentally controlled compartment 12. The compartment 12 contains a thermostatically or humidistat controlled heater 14 for eliminating moisture above an upper limit in essentially the same manner as the Schulze, et al. and MacDonald, Jr. apparatus. Verderber, however, additionally makes provision for adding moisture to the compartment 12 when the humidity therein falls below a lower limit. In the Verderber apparatus, there is a humidifier 14 connected to a blower 16 controlled by a humidistat 18. The air content of the compartment 12 is circulated by the blower 16 through the humidifier 14 when additional humidity is needed between an inlet opening 20 and an outlet opening 22.

The Verderber apparatus apparently works for its intended environment because of certain limitations on that environment and the paper employed in the associated process. As the Verderber patent states, "It is important to note that the size of the chamber 12 must be kept to a minimum, preferably not in excess of 3 cubic feet, inasmuch as an air volume in the chamber in excess of this amount would make maintenance of humidity conditions much more difficult, and hence could possibly involve the use of equipment whose size and cost would be out of scale with the size and cost of the usual copying machine, so as to render the combination of the present invention impractical." It should be noted in this regard that one of the important aspects of the Verderber patent is the fact that the power is always on to the environmental control equipment and the paper for future use is stored in the controlled compartment 12 as well. Verderber is also concerned with standard copy paper which comes in reams of cut sheets typically 8½ by 11 inches. The moisture absorbing qualities of such paper are entirely different from other forms of copy paper.

In the field of X-Y plotters driven by computer, roll paper electrostatic plotters are gaining in popularity because of their ability to produce large, detailed drawings without the necessity of employing a liquid ink pen to draw all the lines as in pen plotters. Such an electrostatic plotter as known in the art is shown in simplified form in FIG. 2 where it is generally indicated as 24. There is a separate paper compartment at the rear of the plotter which is accessed through a hinged door 28. A roll 30 of paper 32 is rotatably supported on its ends by support bars 34. The paper 32 is fed from the roll 30 over guide rollers 36 and through a slot 38 into the printing compartment 40 where electrostatic printing apparatus 42 controlled by the control circuits 44. After the plot is printed onto the paper 32, it is fed over additional guide roller 36' out of the printing compartment 40 where each plot is cut off for use.

The paper 32 has certain qualities which make it unsuitable for use of a humidity control system such as that of Verderber—in part for the very reasons quoted above; that is, the roll 30 is typically three feet in length and tightly wound to a diameter of approximately six to eight inches. Accordingly, its ability to absorb moisture on the roll is quite limited. Any attempt to employ the Verderber approach would, in Verderber's words, "involve the use of equipment whose size and cost would be out of scale with the size and cost of the usual copying machine, so as to render the combination . . . impractical".

Because of the characteristics of the process and the equipment, what is required is a humidity source which can contact the paper 32 in a homogeneous manner principally in the portion between the roll 30 and the slot 38. This portion remains exposed for the duration of the plotting process—which, for a detailed plot, can take several minutes. The portion is then fed into the printing compartment 40 to be replaced by a next exposed portion. The typical plotting environment for such equipment is a high quality computer room having an air conditioning system. Excess moisture is not the problem, only an insufficiency of moisture in the paper. The paper employed is characterized by it ability to rapidly absorb moisture to which it is exposed. It is also characterized by the need to maintain the humidity at about the 50% to obtain good plots where there are areas of high line density. When the humidity falls below this level, the paper is incapable of maintaining a uniform electrostatic charge. As a result, areas of black become gray and lines lose continuity and contain gaps.

Initial attempts by the inventor herein to create a corrective environment took the form depicted in FIG. 2. An enclosure 46 of plastic similar in design and construction to those employed to abate noise in computer printers, and the like, was placed over the entire plotter 24. A piezoelectric humidifier 48 was connected by a duct 50 to conduct cool water vapor (as produced by an ultrasonic device within the humidifier 48) into the enclosure 46. A humidistat 18 was positioned in the enclosure 46 and connected to control the humidifier 48. This arrangement worked with respect to solving the moisture/humidity problem; but, the enclosure 46 was large, heavy, and cumbersome to work with. Aesthetically and operationally, it was undesirable for a commercial environment.

Wherefore, it became the object of the present invention to provide a system for providing a source of moisturizing humidity to the paper of a roll paper electrostatic plotter which is simple, inexpensive, effective, and neither aesthetically nor operationally undesirable for incorporation into such plotters as produced and sold by the assignee hereof.

Other objects and benefits of the present invention will become apparent from the description which follows hereinafter when taken in conjunction with the drawing figures which accompany it.

SUMMARY

The foregoing objects have been achieved by the humidifying system of the present invention for maintaining the moisture content of the paper at a preferred level in an electrostatic plotter having a paper supply compartment rotatably holding a horizontal roll of plotting paper where the paper passes from the roll and through the supply compartment to a separate printing compartment comprising, powered humidifier means including a tank for holding a supply of water to be humidified for supplying cool water vapor at an outlet opening thereof; an adjustable humidistat disposed in the paper supply compartment and operatively connected to turn the humidifier means on and off as a function of the humidity in the paper supply compartment; and, a manifold horizontally disposed across the inside of the paper supply compartment, the manifold having a closed end and an opposite end connected to the outlet opening of the humidifier means, the manifold additionally having a plurality of spaced outlet holes through sidewalls thereof along the length thereof for water vapor introduced into the manifold by the humidifier means to emerge therefrom.

In the preferred embodiment, the holes are positioned to direct water vapor emerging therefrom towards an area of the paper storage compartment having a printing surface of the paper along a side thereof. Further in the preferred embodiment, the holes are positioned to direct water vapor emerging therefrom towards a sidewall of the area of the paper storage compartment whereby the water vapor strikes the sidewall and bounces off to create a homogeneous cloud of the water vapor adjacent the printing surface of the paper.

Also in the preferred embodiment, the manifold is slanted downward from the closed end to create a low point adjacent the opposite end, there is a drain tank for holding condensed water vapor, and a drain pipe is connected between the low point and the drain tank. Sensor means are also operably connected for sensing the level of the condensed water vapor in the tank, for disabling the plotter when the tank is full of the condensed water vapor, and for indication to a plotter operator that the tank is full and the plotter is disabled.

DESCRIPTION OF THE PREFERRED EMBODIMENT

Figure 1:
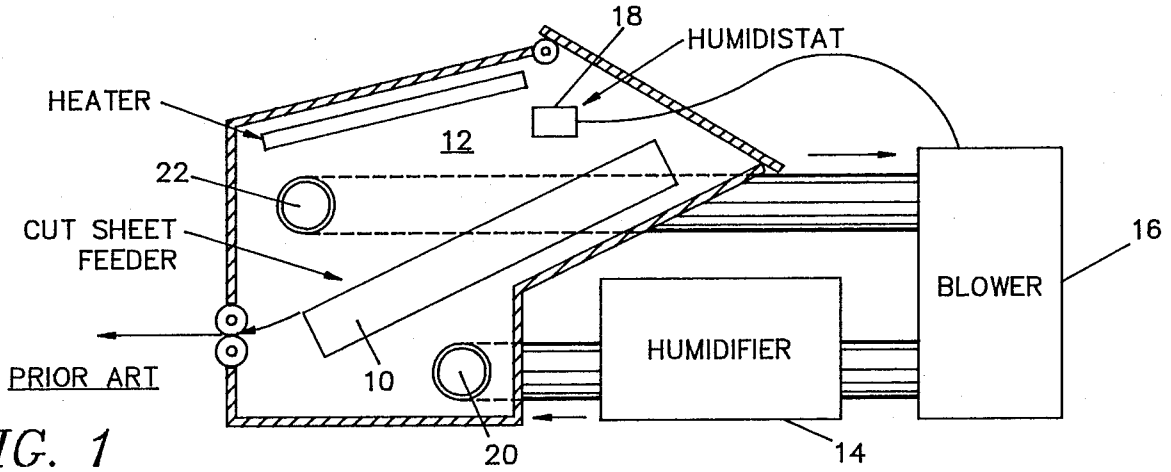
FIG. 1 is a simplified cutaway side view drawing of a prior art heat and humidity control system employed with a cut sheet feeder electrostatic printer.
Figure 2:
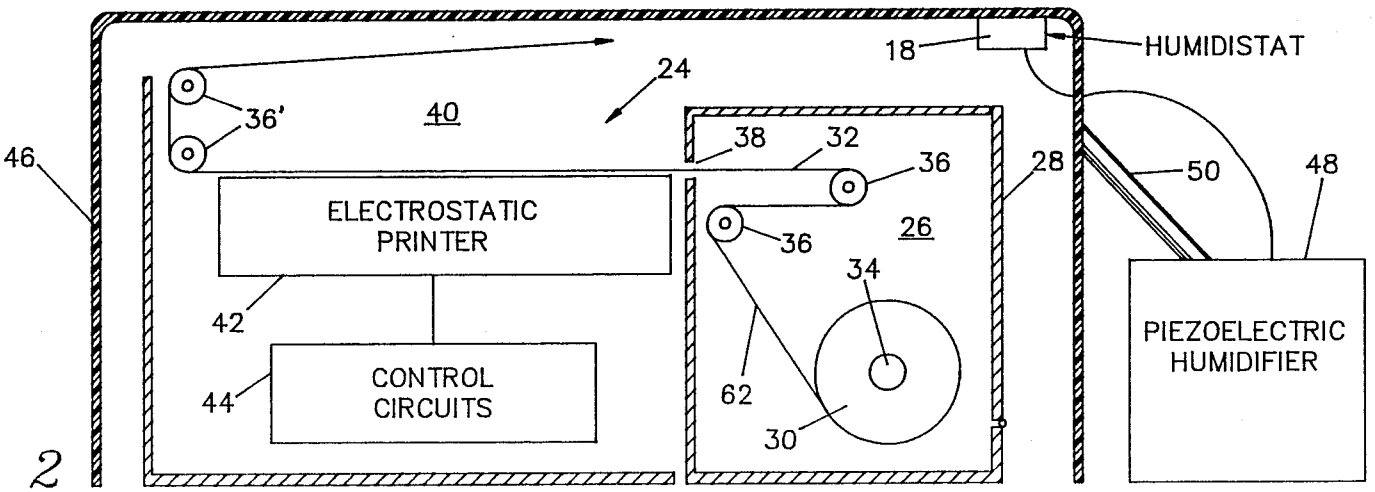
FIG. 2 is a simplified cutaway side view drawing of an early attempt by the inventor herein to solve the problem solved by the present invention.

The present invention is based on the approach of Verderber, i.e. controlling the humidity level within only the compartment holding the roll 30 of paper 32, while solving the problems of the Verderber approach which prevented it from being successfully employed with other than a small compartment and small stacks of cut paper sheets. In particular, this is accomplished by a completely different method of delivering the moisture/humidity. Both Verderber and the present invention recognize the need to employ cool water vapor as opposed to steam. Modern piezoelectric humidifiers such as that discussed with respect to FIG. 2 provide a good source of such cool water vapor and, therefore, a commercially available piezoelectric humidifier 48 intended for home use to humidify a room for therapeutic purposes was employed. While Verderber added humidity to the air circulated through the chamber 12 outside of the chamber creating a requirement for large, cumbersome equipment, the present invention takes the approach of delivering the water vapor through a manifold directly to the site of its need, i.e. the exposed portion of the paper 32 next to be used for plotting. Extensive testing on commercial plotters of the assignee hereof has proved that approach to be both practical and completely successful for its intended purpose.

Figure 3:
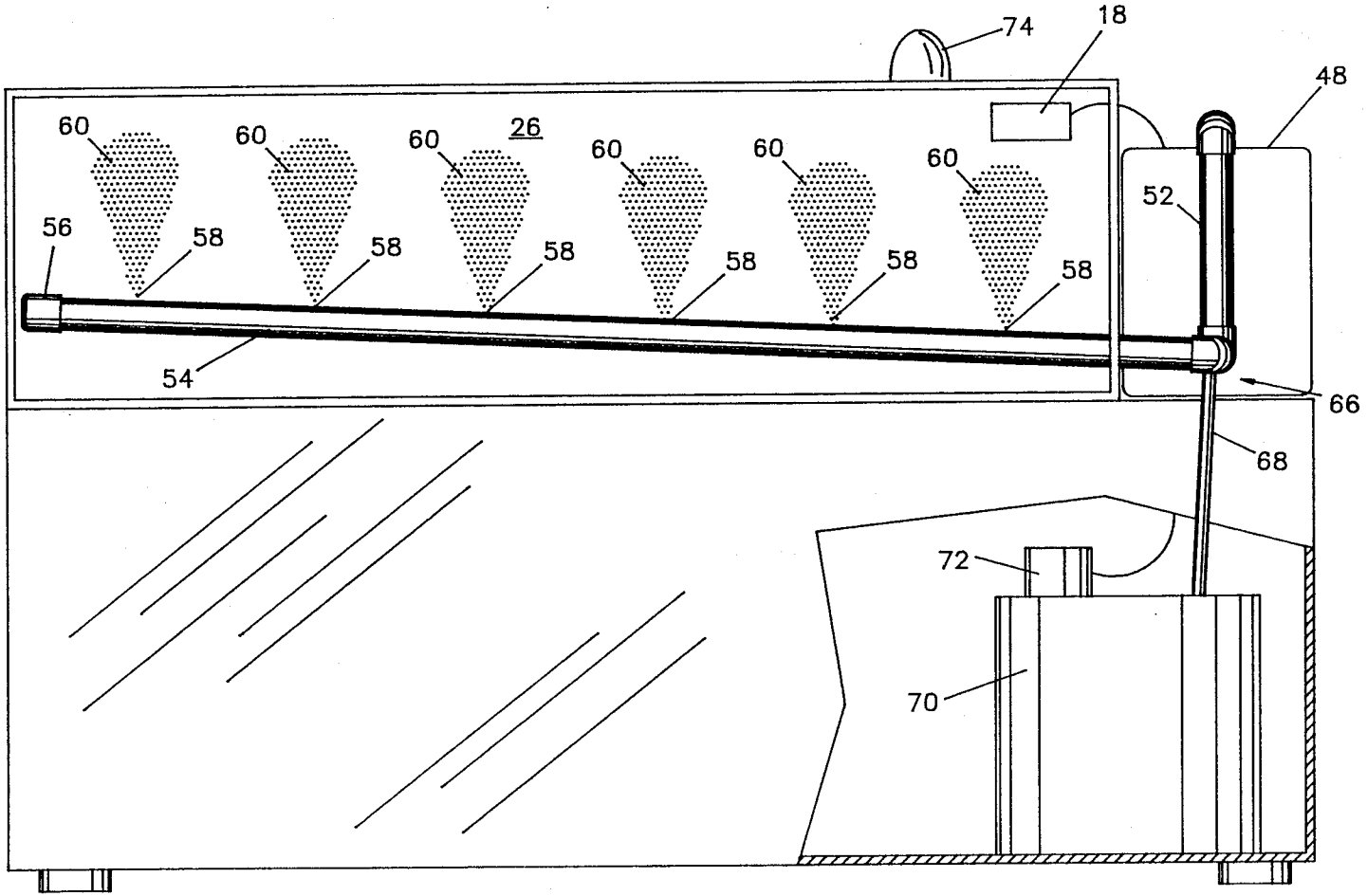
FIG. 3 is a detailed drawing of the roll paper-holding compartment of an electrostatic plotter with the present invention operably connected thereto to control the humidity therein.
Figure 5:
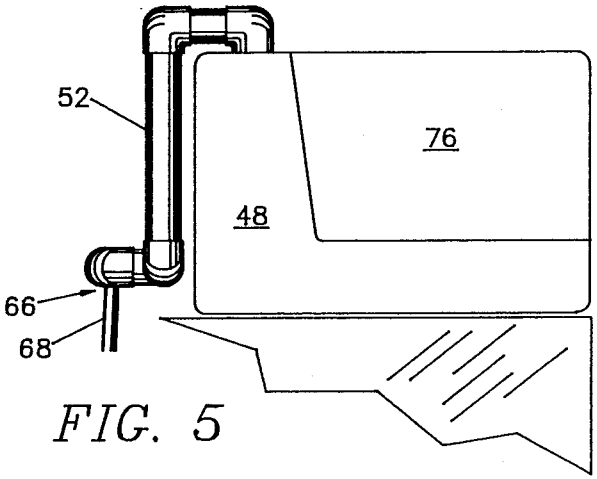
FIG. 5 is an outside end view towards the paper-holding compartment showing the piezoelectric water vaporizer employed in the present invention and its manner of connection to the manifold.
Figure 6:
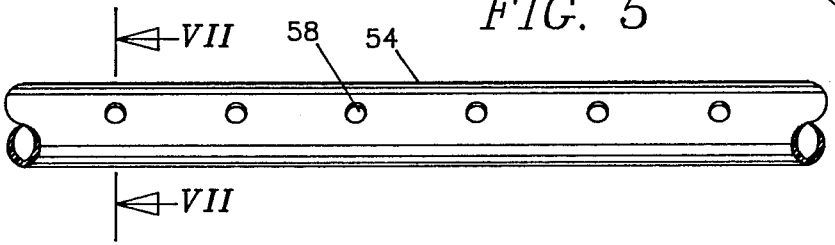
FIG. 6 is an enlarged top view of the manifold showing the outlet openings along the length thereof through which the vaporized water is directed into the paper-holding compartment.
Figure 7:
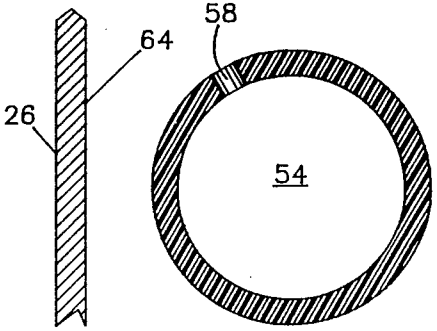
FIG. 7 is a cutaway end view of the manifold of FIG. 6 in the plane VII—VII showing the off-vertical rotation of the outlet opening which prevent the vaporized water from being directed directly onto the surface of the paper.
Figure 4:
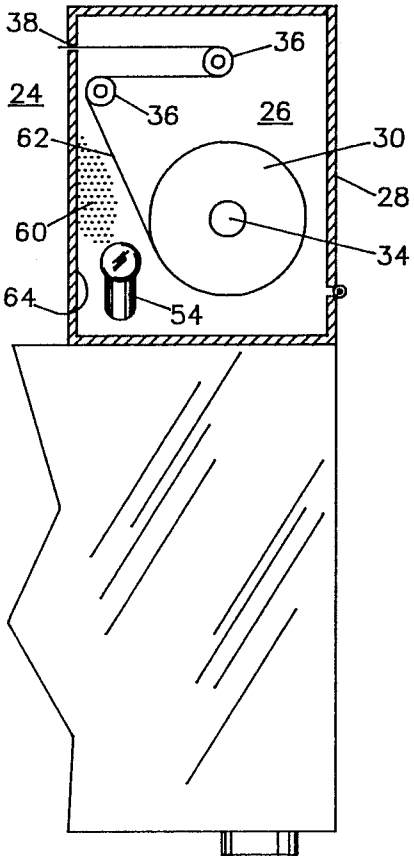
FIG. 4 is an end view of the paper-holding compartment of FIG. 3 showing how the manifold of the present invention directs jets of water vapor against the back wall of the compartment adjacent the printing surface of the roll paper to be indirectly absorbed thereby.

As depicted in FIGS. 3–5, the humidifier 48 is mounted adjacent the paper compartment 26 and the originally supplied outlet nozzle was removed from the humidifier 48 and replaced by pipes 52 connecting the humidifier 48 to one end of a pipe manifold 54 longitudinally disposed across the back of the compartment 26. Both the connecting pipe 52 and the manifold 54 are preferably of ½ inch plastic pipe of the kind used for water pipes in modern plumbing installations because of its ease of assembly and resistance to rusting and corrosion in a moist environment. The manifold 54 is closed on its other end by a cap 56. As can be seen best by reference to FIGS. 4, 6 and 7, the manifold 54 contains a series of spaced outlet holes 58 along the top length thereof. The manifold 54 is positioned to direct the jets of water vapor 60 emerging from the holes 58 into the area between the printing surface 62 of the paper 32 and the back wall 64 of the compartment 26. To prevent the water vapor 60 from directly striking the paper 32 and causing localized wetting thereof, the manifold 54 is rotated to point the holes 58 towards the back wall 64 such that the jets of water vapor 60 emerging therefrom strike the wall 64 at an angle and create a generally homogeneous cloud of water vapor 60 across the exposed printing surface 62 of the paper. If desired, the holes 58 can be made increasingly larger towards the cap 56 as is often done in elongated ducting systems to cause equal outputs along the length as the pressure drops. The present invention was tested both ways (i.e. with equal holes and increasing holes) with little discernable difference in the results. A humidistat 18 is positioned within the compartment 26 and operatively connected to control the operation of the humidifier 48. The humidistat 18 is set to maintain the humidity in the compartment 26 in the ideal range of 45–55% humidity. Thus, as soon as the humidity within the compartment 26 drops below the ideal range (with the portion of the paper 32 next to be employed for plotting quickly following suit as is its characteristic), the humidifier is turned on to create a concentrated and homogeneous cloud of water vapor 60 in the area of greatest need where it is quickly absorbed into the printing surface 62 paper 32.

The use of concentrated water vapor within the compartment 26 in lieu of adding evaporated water vapor to the circulated air volume at a remote location as in the Verderber approach was not without an associated problem—water condensation. The solution to this problem as incorporated into the preferred embodiment of the present invention is shown in FIG. 3. First, while not specifically shown, it should be noted that the communicating crack or slot between the paper compartment 26 and the printing compartment 40 which existed at the bottom of the back wall 64 because of the design and construction of the metal portions of the plotter 24 was sealed with an elastomeric sealing compound to prevent any condensing water from entering the printing compartment 40 and shorting the electrical components therein. More specifically to the solution of the particular problem, however, the manifold 54 is slanted downward from the outer end capped by the cap 56 towards a low point 66 where the manifold 54 is connected to the connecting pipe 52. Thus, all water vapor 60 condensing within the manifold 54 tends to run down the bottom of the manifold 54 to the low point 66. A hole (not shown) is drilled through the pipe 52 at the low point 66 and a small diameter, flexible plastic drain hose 68 is connected therethrough. The opposite end of the drain hose 68 is connected into a removable holding tank 70. In the preferred embodiment, the tank 70 is part of a general drainage system associated with the plotter 24. The tank 70 is provided with a water level sensor 72 connected in series with the power connection to the plotter 24 such that the plotter 24 is prevented from operating when the tank 70 is full of condensate. The sensor 72 is also connected to operate a warning light 74 when the plotter 24 is locked out to inform the plotter operator that the tank 70 should be emptied.

Thus, it can be seen and appreciated from the foregoing description that the present invention has truly met its stated objective by providing a source of moisturizing humidity to the paper of a roll paper electrostatic plotter which is simple, inexpensive, effective, and neither aesthetically nor operationally undesirable for incorporation into commercial electrostatic plotters.

Wherefore, having thus described the present invention, what is claimed is:

1. In an electrostatic plotter having a paper supply compartment rotatably holding a horizontal roll of plotting paper where the paper passes from the roll and through the supply compartment to a separate printing compartment, the improvement for maintaining the moisture content of the paper at a preferred levels comprising:

(a) powered humidifier means disposed externally to the supply compartment and including a tank for holding a supply of water to be humidified for supplying cool water vapor at an outer opening thereof;

(b) an adjustable humidistat disposed in the paper supply compartment and operatively connected to turn said humidifier means on and off as a function of the humidity in the paper supply compartment; and, (c) a manifold horizontally disposed across the inside of the paper supply compartment, said manifold having a closed end and an opposite end connected from above to said outlet opening of said humidifier means, said manifold additionally having a plurality of upward-facing spaced outlet holes through sidewalls thereof along the length thereof for water vapor introduced into said manifold by said humidifier means to emerge therefrom whereby the bottom of said manifold acts as a condensate trough.

2. The improvement to an electrostatic plotter of claim 1 wherein:

said holes are positioned to direct water vapor emerging therefrom towards an area of the paper storage compartment having a printing surface of the paper along a side thereof.

3. The improvement to an electrostatic plotter of claim 2 wherein:

said holes are positioned to direct water vapor emerging therefrom towards a sidewall of said area of the paper storage compartment whereby said water vapor strikes said sidewall and bounces off to create a homogeneous cloud of said water vapor adjacent said printing surface of the paper.

4. The improvement to an electrostatic plotter of claim 1 wherein:

(a) said manifold is slanted downward from said closed end to create a low point adjacent said opposite end; and additionally comprising, (b) a drain tank for holding condensed water vapor; and, (c) a drain pipe connected between said low point and said drain tank.

5. The improvement to an electrostatic plotter of claim 4 and additionally comprising:

sensor means operably connected for sensing the level of said condensed water vapor in said tank, for disabling the plotter when said tank is full of said condensed water vapor, and for indicating to a plotter operator that said tank is full and the plotter is disabled.

6. A humidifying system for maintaining the moisture content of the paper at a preferred level in an electrostatic plotter having a paper supply compartment rotatably holding a horizontal roll of plotting paper where the paper passes from the roll and through the supply compartment to a separate printing compartment, comprising:

(a) powered humidifier means disposed externally to the supply compartment and including a tank for holding a supply of water to be humidified for supplying cool water vapor at an outlet opening thereof;

(b) an adjustable humidistat disposed in the paper supply compartment and operatively connected to turn said humidifier means on and off as a function of the humidity in the paper supply compartment; and, (c) a manifold horizontally disposed across the inside of the paper supply compartment, said manifold having a closed end and an opposite end connected from above to said outlet opening of said humidifier means, said manifold additionally having a plurality of upward-facing spaced outlet holes through sidewalls thereof along the length thereof for water vapor introduced into said manifold by said humidifier means to emerge therefrom whereby the bottom of said manifold acts as a condensate trough.

7. The humidifying system for an electrostatic plotter of claim 6 wherein:

said holes are positioned to direct water vapor emerging therefrom towards an area of the paper storage compartment having a printing surface of the paper along a side thereof.

8. The humidifying system for an electrostatic plotter of claim 7 wherein:

said holes are positioned to direct water vapor emerging therefrom towards a sidewall of said area of the paper storage compartment whereby said water vapor strikes said sidewall and bounces off to create a homogeneous cloud of said water vapor adjacent said printing surface of the paper.

9. The humidifying system for an electrostatic plotter of claim 6 wherein:

(a) said manifold is slanted downward from said closed end to create a low point adjacent said opposite end; and additionally comprising, (b) a drain tank for holding condensed water vapor; and, (c) a drain pipe connected between said low point and said drain tank.

10. The humidifying system for an electrostatic plotter of claim 9 and additionally comprising:

sensor means operably connected for sensing the level of said condensed water vapor in said tank, for disabling the plotter when said tank is full of said condensed water vapor, and for indicating to a plotter operator that said tank is full and the plotter is disabled.

* * * * *